United States Patent [19]

Buck et al.

[11] Patent Number: 4,512,652

[45] Date of Patent: Apr. 23, 1985

[54] CONTROL SCHEME COMPENSATING FOR CHANGING CHARACTERISTICS OF A PHOTOCONDUCTIVE MEMBER USED IN AN ELECTROPHOTOGRAPHIC PRINTING MACHINE

[75] Inventors: Kenneth J. Buck, Ontario; Robert E. Grace, Fairport; Thomas A. Hayes, Jr., Leroy, all of N.Y.

[73] Assignee: Xerox Corporation, Stamford, Conn.

[21] Appl. No.: 525,855

[22] Filed: Aug. 24, 1983

[51] Int. Cl.[3] ..... G03G 15/00

[52] U.S. Cl. ..... 355/14 CH; 430/902

[58] Field of Search ..... 355/3 CH, 14 CH; 250/324, 325, 326; 361/225, 229; 430/31, 902

[56] References Cited

U.S. PATENT DOCUMENTS

| | | | |
|---|---|---|---|
| 3,805,069 | 4/1974 | Fisher | 250/326 |
| 4,312,589 | 1/1982 | Brannan et al. | 355/14 CH |
| 4,326,796 | 4/1982 | Champion et al. | 355/14 CH |
| 4,456,370 | 6/1984 | Hayes, Jr. | 355/14 CH |

FOREIGN PATENT DOCUMENTS

| | | | |
|---|---|---|---|
| 163240 | 10/1982 | Japan | 355/14 CH |

OTHER PUBLICATIONS

*Xerox Disclosure Journal*, vol. 1, No. 2, Feb. 1976, Hudson, F. W., "Self Adjusting Corona Device,", p. 67.

*Primary Examiner*—A. T. Grimley
*Assistant Examiner*—J. Pendegrass
*Attorney, Agent, or Firm*—H. Fleischer; J. E. Beck; R. Zihelli

[57] ABSTRACT

An electrophotographic printing machine in which a controller regulates charging of a photoconductive member in accordance with information stored therein. The controller determines the charging current as a function of the rest time between successive copying cycles.

12 Claims, 2 Drawing Figures

Figure 1:
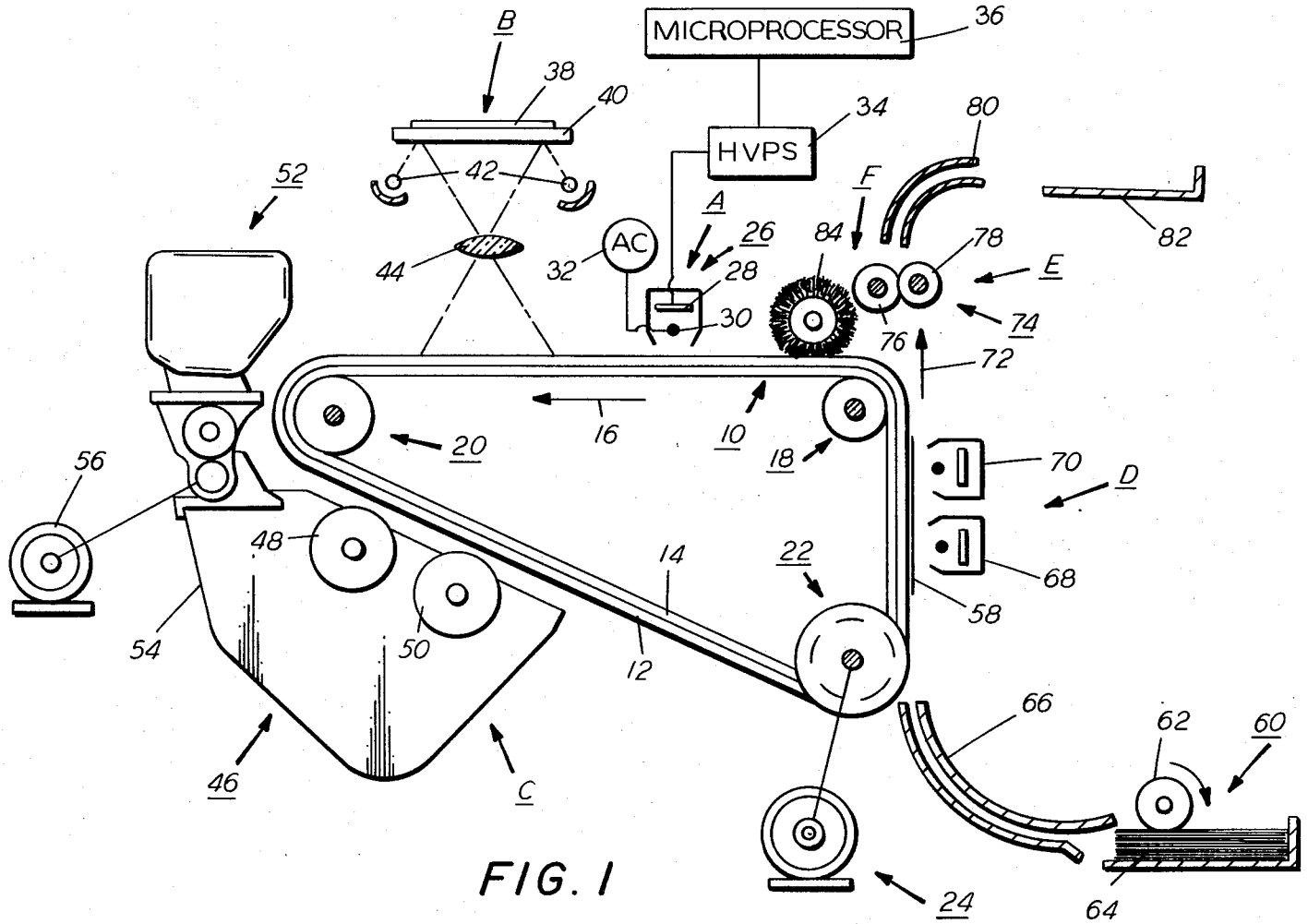

CONTROL SCHEME COMPENSATING FOR CHANGING CHARACTERISTICS OF A PHOTOCONDUCTIVE MEMBER USED IN AN ELECTROPHOTOGRAPHIC PRINTING MACHINE

This invention relates generally to an electrophotographic printing machine, and more particularly concerns a scheme for controlling charging of a photoconductive member to compensate for changes in the characteristics thereof.

In the process of electrophotographic printing, the photoconductive member is uniformly charged and exposed to a light image of an original document. Exposure of the photoconductive member records an electrostatic latent image corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner partcles are attracted from the carrier granules to form a toner powder image on the photoconductive member which corresponds to the informational areas contained within the original document. This toner powder image is subsequently transferred to a copy sheet and permanently affixed thereto in image configuration.

In electrophotographic printing machines, it has been found that the photoconductive member exhibits an increased rate of decay of the electrical potential in the dark as a function of copy run length and age. As the rate of dark decay increases, an increased amount of charging current is required to maintain the surface potential at the desired potential. The printing machine is normally adapted to adjust the charging current to compensate for dark decay. However, in the interval between copy runs, the photoconductive member rests and the rate of dark delay tends to return to its initial value. If a new copy run is initiated at the same charging current as that of the prior copy run, and a rest time of more than a few minutes has elapsed while employing an aged, fatigued photoconductive member, the result will be excessively high surface potential and visible copy quality defects. Heretofore, photoconductive surface potential sensors, such as electrometers, have been employed to adjust the charging current prior to making the first copy of the new run. Different types of electrometer systems have been employed to measure the electrical characteristics of the photoconductive surface. For example, U.S. Pat. No. 2,781,705 issued in 1957 to Crumline et al., U.S. Pat. No. 2,852,651 issued in 1958 to Crumline et al., U.S. Pat. No. 2,056,487 issued in 1962 to Giaimo, Jr., U.S. Pat. No. 3,013,203 issued in 1961 to Allen et al., U.S. Pat. No. 3,068,056 issued in 1962 to Kodichini, U.S. Pat. No. 3,321,307 issued to Urbach in 1967, U.S. Pat. No. 3,406,334 issued in 1969 to Marquart et al., U.S. Pat. No. 3,483,705 issued in 1969 to King, U.S. Pat. No. 3,611,982 issued in 1951 to Coriale, U.S. Pat. No. 3,654,893 issued in 1972 to Piper et al., U.S. Pat. No. 3,674,353 issued in 1972 to Tractenburg and U.S. Pat. No. 3,749,488 issued in 1973 to Delome, all describe the advantages of using an electrometer to measure photoconductive charge. Other patents which disclose electrometer systems are U.S. Pat. Nos. 3,370,225 issued in 1968 to Winder and 3,449,668 issued in 1969 to Blackwell et al.. Examples of electrometer systems are disclosed in "Electrophotography" by Schaeffert and "Xerography and Related Processes" by Dessauer and Clark, both published in 1965 by Focal Press, Ltd., London, England. Pages 99 through 100, inclusive, and pages 213 through 216, inclusive, of "Electrophotography" relate specifically to electrometers. Electrometers have also been employed in a closed loop system for regulating various processing stations within the printing machine. The electrometer provides a signal proportional to the dark development potential of the photoconductive surface. The signal is then conveyed to a controller which regulates a high voltage power supply energizing a corona generating device charging the photoconductive surface.

Various types of schemes have been devised for controlling the parameters of an electrophotographic printing machine. The following disclosures appear to be relevant:

U.S. Pat. No. 3,805,069, Patentee: Fisher, Issued: Apr. 16, 1974; U.S. Pat. No. 4,326,796, Patentee: Champion et al., Issued: Oct. 27, 1982. Xerox Disclosure Journal, Authur: Hudson, Vol. 1, No. 2, Feb. 1976, Page 67.

The relevant portions of the foregoing disclosures may be briefly summarized as follows:

Fisher discloses a closed loop system for controlling the power supply regulating the charging of a corona generating device in response to temperature variations on the photoconductive surface.

Champion et al. describes a probe positioned closely adjacent to a photoconductive surface. The probe is charged in accordance with the charge potential on the photoconductive surface. Control logic processes the signal from the probe and adjusts parameters within the printing machine to compensate for deviations of the charge of the photoconductive surface from preselected values.

Hudson describes a system wherein the charge on the photoconductive surface is compared to a reference potential with the error signal being used to control charge by the corona generating device.

In accordance with one aspect of the present invention, there is provided an electrophotographic printing machine including a photoconductive member and means for charging the photoconductive member to a selected potential. Means control the charging means to regulate the current charging the photoconductive member in accordance with information stored in the controlling means to compensate for changes in the characteristics of the photoconductive member.

Pursuant to another aspect of the present invention, there is provided a method of electrophotographic printing including charging a photoconductive member to a selected potential. The charging of the photoconductive member is controlled in accordance with information stored on a controller to compensate for changes in the characteristics of the photoconductive member.

Figure 2:
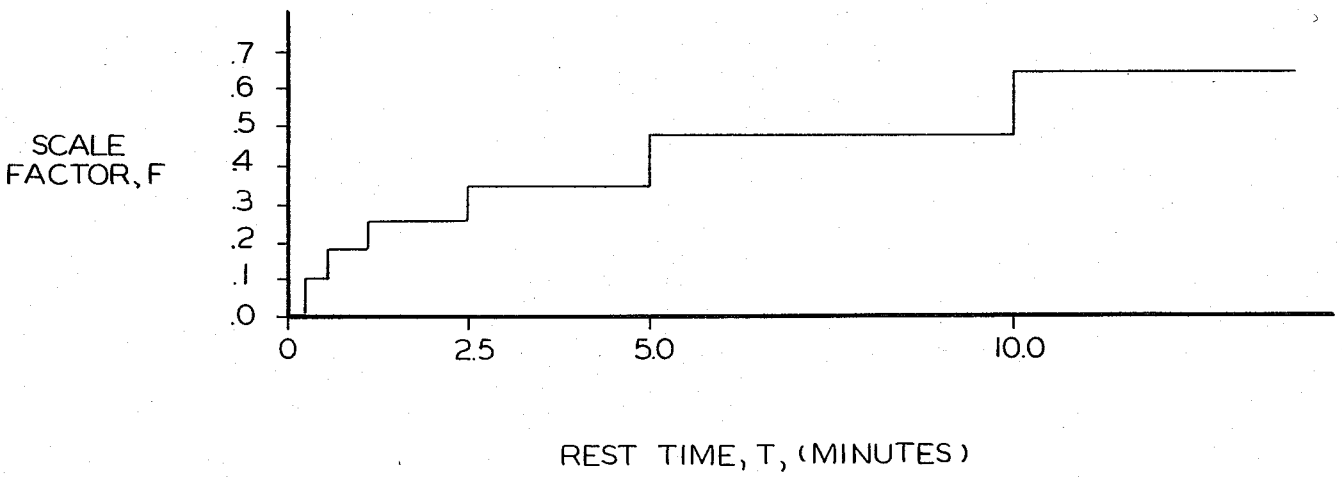

Other aspects of the present invention will become apparent as the following description proceeds and upon reference to the drawings, in which:

FIG. 1 is a schematic elevational view showing an electrophotographic printing machine incorporating the features of the present invention therein; and FIG. 2 is a graph depicting a plot of the scale factor used to adjust charging of the photoconductive member in the FIG. 1 printing machine.

While the present invention will hereinafter be described in connection with the preferred embodiment and method of use thereof, it will be understood that it is not intended to limit the invention to that embodiment or method of use. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating a microprocessor storing the information therein adapted to control the charging system of the printing machine to compensate for changes in the characteristics of the photoconductive member. It will become apparent from the following discussion that the features of the present invention are equally well suited for use in a wide variety of electrostatographic printing machines and are not necessarily limited in their application to the particular embodiment shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the illustrative electrophotographic printing machine employs a belt 10 having a photoconductive surface 12 deposited on a conductive substrate 14. Preferably, photoconductive surface 12 includes a charge generator layer having photoconductive particles randomly dispersed in an electrically insulating organic resin. Conductive substrate 14 comprises a charge transport layer having transparent, electrically inactive polycarbonate resin with one or more diamines dissolved therein. A photoconductive belt of this type is disclosed in U.S. Pat. No. 4,265,990 issued to Stolka et al. in 1981, the relevant portions thereof being hereby incorporated into the present invention. Belt 10 moves in the direction of arrow 16 to advance successive portions of photoconductive surface 12 sequentially through the various processing stations disposed about the path of movement thereof. Belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means, such as a belt drive. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential. Corona generating device 26 has a conductive shield 28 and a dicorotron electrode 30. Electrode 30 is made preferably from an elongated bare wire having a relatively thick electrically insulating layer thereon. The insulating layer is of a thickness which precludes a DC corona current when an AC voltage is applied to the wire with the shield and photoconductive surface being at the same potential. In the absence of an external field supplied by either a bias applied to the shield or a charge on the photoconductive surface, there is substantially no net DC curent flow. Electrode 30 is connected to a high voltage alternating current power supply 32 which produces approximately 6000 volts AC sine wave. A corona is produced about electrode 30 causing a conductive ion plasma of gas. The gas plasma acts as a resistance path between photoconductive surface 12 and shield 28. When charging photoconductive surface 12, shield 28 is electrically biased to a negative voltage causing a current to flow between the shield and photoconductive surface. High voltage power supply 34 is coupled to shield 28. A change in the output of power supply 34 causes corona generating device 26 to vary the charge voltage applied to photoconductive surface 12. Microprocessor 36 controls the output from power supply 34. Microprocessor 36 is preferably a programmable microprocessor which controls all of the machine functions. The microprocessor stores the information necessary to regulate the output from high voltage power supply 34 in order to compensate for changing characteristics of photoconductive surface 12. High voltage power supply 34 is regulated to produce a high charging current. The new or desired charging current is expressed as:

$$C_N = C_O - F(C_O - C_S - C_E)$$

where:

$C_N$ is the new charging current;

$C_O$ is the charging current at the end of the prior copy cycle;

$C_S$ is the charging current at the start of the day;

$C_E$ is the control patch reflectance readings measured by a control reflectance system as described in U.S. Pat. No. 4,318,610 issued to Grace in 1982, the relevant portions thereof being hereby incorporated into the present invention, corresponds to changes in charging current during the prior cycle; and F is a scale factor which varies as a function of the rest time between the end of a copy cycle and the start of a new copy cycle.

The microprocessor also stores the rest time which is measured by an interval timer which starts at the completion of a copy cycle run and stops when the "Print" button is actuated. The measured rest time is used to determine the scale factor F, which is shown in FIG. 2. Thus, microprocessor 36 continually adjusts power supply 34 so that corona generating device 26 produces the requisite charging current. By way of example, if the charging current at the start of the day was 130 microamps, and at the end of the prior copy cycle, 160 microamps with the control patch reflectance reading being equal to −5 microamps at the first copy of the preceding copy run, and the rest time between the prior copy cycle and the present copy cycle being 10 minutes, the scale factor as obtained from the graph shown in FIG. 2 is 0.6. The new charging current will now be 145 microamps. Thus, high voltage power supply 34 has its voltage output controlled by microprocessor 36 to regulate the charging current produced by corona generating device 26. In this way, changes in the characteristics of the photoconductive surface are compensated for. Microprocessor 36 retains, in its memory, the net charging current changes as measured by a continuous count of change requests and by adaptively modifying that count whenever a control patch reflectance readings is obtained above a preset threshold value, as measured in the first set of readings taken at the start of a copy run. After photoconductive surface is charged to the requisite level, belt 10 advances the charged portion thereof to exposure station B.

With continued reference to FIG. 1, at exposure station B, an original document 38 is positioned face-down upon a transparent platen 40. Lamps 42 flash light rays onto original document 38. The light rays reflected from original document 38 are transmitted through lens 44 forming a light image thereof. Lens 44 focuses the light image onto the charged portion of photoconductive surface 12 to selectively dissipate the charge thereof. This records an electrostatic latent image on photoconductive surface 12 which corresponds to the informational areas contained within original document 38.

One skilled in the art will appreciate that alternative systems may be employed to selectively dissipate the charge recorded on photoconductive surface 12. For example, a modulated light beam, I.E. a laser beam, may be used. The laser beam is modulated by a suitable logic circuitry to selectively dissipate the charged portion of the photoconductive surface. In this way, the information that is electronically generated may be recorded as an electrostatic latent image on the photoconductive surface. Exemplary systems of this type are electronic printing systems.

Exposure station B includes a test area generator which comprises a light source electronically programmed to two different output levels. In this way, two different intensity test light images are projected onto the charged portion of photoconductive surface 12 in the inter-image area to record two test areas thereon. The light output level from the test area generator is such that one of the test light images is exposed to a greater intensity light than the other. These test light images are projected onto the charged portion of photoconductive surface 12 to form test areas. Both of these test areas are subsequently developed with toner particles. After the electrostatic latent image has been recorded on photoconductive surface 12 and the test areas are recorded in the inter-image areas, belt 10 advances the electrostatic latent image and the test areas to development station C. The detailed manner in which the test areas are recorded on photoconductive surface 12 is described in hereinbefore mentioned U.S. Pat. No. 4,318,610 issued to Grace in 1982, the relevant portions thereof being hereby incorporated into the present application.

At development station C, a magnetic brush development system, indicated generally by the reference numeral 46, advances the developer material into contact into the electrostatic latent image and the test areas. Preferably, the magnetic brush development system 46 includes two magnetic brush developer rollers 48 and 50. These rollers each advance developer material into contact with the latent and the test areas. Each developer roller forms a brush comprising carrier granules and toner particles. The latent image and test areas attract the toner particles from the carrier granules forming a toner powder image on the latent image and a pair of developed areas corresponding to each of the test areas. As successive latent images are developed, toner particles are depleted from the developer material. A toner dispenser, indicated generally by the reference numeral 52, is arranged to furnish additional toner particles to developer housing 54 for subsequent use by developer roller 48 and 50, respectively. Toner dispenser 52 includes a container storing a supply of toner particles therein. A foam roller disposed in the sump coupled to the container dispenses toner particles into an auger. Motor 56 rotates the auger to advance the toner particles through a tube having a plurality of apertures therein. The toner particles are dispensed from the apertures in the tube into developer housing 54. The developed test area is passed beneath a collimated infrared densitometer. The infrared densitometer, positioned adjacent photoconductive surface 12 between development station C and transfer station D, generates electrical signals proportional to the developed toner mass of the test areas. These signals are conveyed to microprocessor 36 which regulates high voltage power supply 34. This corresponds to the previously mentioned control patch reflectance readings disclosed in heretofore mentioned U.S. Pat. No. 4,318,610 issued to Grace in 1982, the relevant portions thereof being hereby incorporated into the present application.

A sheet of support material 58 is advanced into contact with the toner powder image at transfer station D. Support material 58 is advanced to transfer station D by sheet feeding apparatus 60. Preferably, sheet feeding apparatus 60 includes a feed roll 62 contacting the uppermost sheet of stack 64. Feed roll 62 rotates to advance the uppermost sheet from stack 64 into chute 66. Chute 66 directs the advancing sheet of support material into contact with photoconductive surface 12 in a timed sequence so that the toner powder image developed thereon contacts the advancing sheet of support material at transfer station D.

Transfer station D includes a corona generating device 68 which sprays negative ions onto the back side of sheet 58. In this way, the toner powder images, which comprise positive toner particles, are attracted from photoconductive surface 12 to sheet 58. Subsequent to transfer, sheet 58 moves past a detack corona generating device 70. Corona generating device 70, at least partially, neutralizes the charges placed on the back side of sheet 58. The partial neutralization of the charge on the back side of sheet 58 reduces the bonding force holding it to photoconductive surface 12 of belt 10. This enables the sheet to be stripped as the belt moves around the sharp end of stripping roller 18. After detack, the sheet continues to move in the direction of arrow 72 onto a conveyor (not shown) which advances the sheet of fusing station E.

Fusing station E includes a fuser assembly, indicated generally by the reference numeral 74, which permanently affixes the transferred powder image to sheet 58. Preferably, fuser assembly 74 comprises a heated fuser roller 76 and a back-up roller 78. Sheet 58 passes between fuser roller 76 and back-up roller 78 with the toner powder image contacting fuser roller 76. In this manner, the toner powder image is permanently affixed to sheet 58. Chute 80 guides the advancing sheet 58 to catch tray 82 for subsequent removal from the printing machine by the operator.

After the sheet of support material is separated from photoconductive surface 12 of belt 10, the residual toner particles adhering to photoconductive surface 12 are removed therefrom. These particles are cleaned from photoconductive surface 12 at cleaning station F. By way of example, cleaning station F includes a rotatably mounted fibrous brush 84 in contact with photoconductive surface 12. The particles are cleaned from photoconductive surface 12 by the rotation of brush 84 in contact therewith. Subsequent to cleaning, a discharge lamp (not shown) floods photoconductive surface 12 with light to dissipate any residual electrostatic charge remaining thereon prior to the charging thereof for the next successive imaging cycle.

Turning now to FIG. 2, there is shown a graph wherein the scale factor employed to determine the new current is plotted as a function of the rest time between successive copy cycles. It should be noted that each copy cycle comprises making at least one copy of one original document. However, a copy cycle may comprise making a plurality of copies from one original document or making one copy from a plurality of original documents. The rest time, in minutes, is measured from the end of the copy cycle to when the "Print" button is pressed to start a new copy cycle. This information is stored in microprocessor 36. The measured rest time is used to determine a scale factor via a reference table stored in the memory of microprocessor 36. This reference table is graphically depicted in FIG. 2. The relationship between the scale factor, F, and rest time is a stepwise approximation to a logarithmic function. Thus, the scale factor, F, may be expressed by the following relationship:

$$F=0.1 \log_2(T/N)$$

where:

T is the measured rest time; and

N is the constant selected to match the recovery characteristics of photoconductive surface 12.

With a knowledge of the rest time, in minutes, the requisite scale factor, F, may be readily determined from FIG. 2. Microprocessor 36 may then determine the required charging current necessary to compensate for changes in the characteristics of the photoconductive surface and control power supply 34 accordingly. This compensates for variations in dark decay characteristics and provides a substantially instantaneous correction without any time delay.

It is, therefore, apparent that there has been provided, in accordance with the features of the present invention, a technique for compensating for changes in the characteristics of the photoconductive surface of an electrophotographic printing machine by instaneously correcting the charging current for each successive copying cycle that fully satisfies the aims and advantages hereinbefore set forth. While this invention has been described in conjunction with a specific embodiment and method of use thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine, including:

a photoconductive member;

means for charging said photoconductive member to a selected potential; and means for controlling said charging means to regulate the current charging said photoconductive member, said controlling means calculating a scale factor as a function of the time elapsed between successive operating cycles and a constant characterizing said photoconductive member and regulating the current charging said photoconductive member as a function of the calculated scale factor.

2. A printing machine according to claim 1, wherein said charging means includes:

a shield;

an electrode operatively associated with said shield; and means for electrically biasing said shield.

3. A printing machine according to claim 2, wherein said controlling means is in operative communication with said biasing means to adjust the voltage level of said shield for the next successive operating cycle regulating the current charging the photoconductive member.

4. A printing machine according to claim 3, wherein said controlling means stores the level of the current charging the photoconductive member during the previous operating cycle and the level of the charging current at the start of the day.

5. A printing machine according to claim 4, wherein said controlling means calculates the charging current for the new operating cycle as a function of the charging current at the start of the day, the charging current of the previous opeating cycle and the scale factor, said controlling means measuring any change in charging current during a cycle and incorporating these charging current changes into the calculation of the charging current for the new operating cycle.

6. A printing machine according to claim 5, further including:

means for exposing the charged portion of the photoconductive member to a light image of the original document being reproduced to record a latent image thereon;

means for developing the latent image recorded on the photoconductive member with marking particles to form a powder image thereon;

means for transferring the powder image to a copy sheet; and means for fixing the powder image to the copy sheet.

7. An electrophotographic printing machine, including:

a photoconductive member;

means for charging said photoconductive member to a selected potential, said charging means includes a shield, an electrode operatively associated with said shield, and means for electrically biasing said shield; and means for controlling said charging means to regulate the current charging said photoconductive member in accordance with information stored in said controlling means compensating for changes in the characteristics of said photoconductive member, said controlling means regulates the current charging said photoconductive member as a function of the time elapsed between successive operating cycles of the printing machine with the printing machine reproducing at least one copy of at least one original document during each operating cycle with the time period between successive operating cycles being measured and stored in said controlling means, said controlling means being in operative communication with said biasing means to adjust the voltage level of said shield for the next successive operating cycle regulating the current charging the photoconductive member, said controlling means stores the level of the current charging said photoconductive member during the previous operating cycle and the level of the charging current at the start of the day, and said controlling means calculates a scale factor as a function of the time elapsed between successive operating cycles and a constant characterizing the photoconductive member.

8. A method of electrophotographic printing, including the steps of:

charging a photoconductive member to a selected potential;

calculating a scale factor as a function of the time elapsed between successive operating cycles and a constant characterizing the photoconductive member; and controlling said step of charging in accordance with the calculated scale factor.

9. A method of printing according to claim 8, wherein said step of controlling includes the step of storing the level of current charging the photoconductive member during the previous operating cycle and the level of the charging current at the start of the day.

10. A method of printing according to claim 9, wherein said step of controlling includes the steps of:

measuring any errors in the charging current; and calculating the charging current for the new operating cycle as a function of the charging current of the previous operating cycle, the scale factor, and the charging current changes during a cycle.

11. A method of printing according to claim 10, further including the steps of:

exposing the charged portion of the photoconductive member to a light image of an original document being reproduced to record a latent image thereon;

developing the latent image recorded on the photoconductive member with marking particles to form a powder image thereon;

transferring the powder image to a copy sheet; and fusing the powder image to the copy sheet.

12. A method of electrophotographic printing, including the steps of:

charging a photoconductive member to a selected potential; and controlling said step of charging in accordance with information stored in a controller compensating for changes in the characteristics of the photoconductive member, said step of controlling includes the step of regulating the current charging the photoconductive member as a function of the time elapsed between successive operating cycles, said step of controlling includes the step of storing the level of current charging the photoconductive member during the previous operating cycle and the level of the charging current at the start of the day, said step of controlling includes the step of calculating a scale factor as a function of the time elapsed betweefn operating cycles and a constant characterizing the photoconductive member.

* * * * *